US010315229B2

(12) United States Patent
Pano et al.

(10) Patent No.: US 10,315,229 B2
(45) Date of Patent: Jun. 11, 2019

(54) POSTAL SORTING MACHINE HAVING A SORTING OUTLET JOGGER PROVIDED WITH A QUICK-RELEASE HELICAL-BLADE WHEEL

(71) Applicant: Solystic, Bagneux (FR)

(72) Inventors: Damien Pano, Valence (FR); Raymond Chifflet, Guilherand Granges (FR); Frédéric Mestrallet, Etoile sur Rhone (FR)

(73) Assignee: SOLYSTIC, Bagneux (FR)

( * ) Notice: Subject to any disclaimer, the term of this patent is extended or adjusted under 35 U.S.C. 154(b) by 7 days.

(21) Appl. No.: 15/671,702

(22) Filed: Aug. 8, 2017

(65) Prior Publication Data

US 2018/0036772 A1 Feb. 8, 2018

(30) Foreign Application Priority Data

Aug. 8, 2016 (FR) ..... 16 57637

(51) Int. Cl.
*B65H 29/42* (2006.01)
*B65H 29/38* (2006.01)
(Continued)

(52) U.S. Cl.
CPC ..... *B07C 3/008* (2013.01); *B07C 3/06* (2013.01); *B07C 3/14* (2013.01); *B65H 29/42* (2013.01);
(Continued)

(58) Field of Classification Search
CPC ..... B65H 2301/4214; B65H 29/42; B65H 2701/1916; B65H 31/06; B65H 29/52; B65H 2402/515; B07C 1/025; F16H 7/20
See application file for complete search history.

(56) References Cited

U.S. PATENT DOCUMENTS 1,722,599 A * 7/1929 Test ..... F16H 55/44 474/197
4,270,747 A * 6/1981 Templeton ..... B65H 29/42 271/179
(Continued)

FOREIGN PATENT DOCUMENTS

JP H0899755 A 4/1996
WO 2013046862 A 4/2013

OTHER PUBLICATIONS

European Search Report dated Nov. 30, 2017; 2 pages.

*Primary Examiner* — Gregory W Adams
(74) *Attorney, Agent, or Firm* — Dickinson Wright PLLC

(57) ABSTRACT

A postal sorting machine comprises an unstacker in a mailpiece feed inlet, a sorting conveyor, and sorting outlets, each of which is provided with a receptacle designed for storing the mailpieces in a stack and on an edge. Each sorting outlet is provided with a wheel having a helical blade. The wheel projects through an opening in the bottom of the receptacle and is mounted on a transmission shaft. The transmission shaft is disposed under the receptacle to impart a rotary movement to the helical blade so that the helical blade pushes the base of a current mailpiece in the receptacle against the stack of mailpieces that is being formed. The wheel is also mounted on the transmission shaft by being clipped by moving in translation across the axis of rotation of the transmission shaft.

4 Claims, 3 Drawing Sheets

(51) Int. Cl.

| | |
|---|---|
| ***B07C 3/00*** | (2006.01) |
| ***B07C 3/06*** | (2006.01) |
| ***B07C 3/14*** | (2006.01) |
| ***B65H 31/06*** | (2006.01) |

(52) U.S. Cl.
CPC ..... *B65H 31/06* (2013.01); *B65H 2301/4214* (2013.01); *B65H 2402/5153* (2013.01); *B65H 2601/324* (2013.01); *B65H 2701/1916* (2013.01)

(56) References Cited

U.S. PATENT DOCUMENTS

| | | | | | |
|---|---|---|---|---|---|
| 4,757,985 | A * | 7/1988 | Hamant | B65H 1/025 | 271/146 |
| 5,217,218 | A * | 6/1993 | Ricciardi | B65H 29/42 | 271/176 |
| 5,219,432 | A * | 6/1993 | Delbe | B07C 1/025 | 271/103 |
| 5,816,570 | A * | 10/1998 | Paradis | B65H 29/42 | 271/179 |
| 5,957,448 | A * | 9/1999 | Frank | B07C 1/025 | 271/148 |
| 6,817,607 | B2 * | 11/2004 | Gasch | B65H 31/06 | 271/177 |
| 9,169,100 | B2 * | 10/2015 | Stojanovski | B65H 31/26 | |

* cited by examiner

POSTAL SORTING MACHINE HAVING A SORTING OUTLET JOGGER PROVIDED WITH A QUICK-RELEASE HELICAL-BLADE WHEEL

CROSS-REFERENCE TO RELATED APPLICATIONS

This application claims the benefit of French Patent Application No. 1657637, filed on Aug. 8, 2016.

TECHNICAL FIELD

The invention relates to a postal sorting machine, e.g. for preparing a delivery round or "postman's walk," which postal sorting machine comprises an unstacker in a mailpiece feed inlet via which mailpieces are fed in, a sorting conveyor designed to put the mailpieces unstacked from the feed inlet in series and on edge, and sorting outlets, each of which is provided with a receptacle designed to store the mailpieces coming from said sorting conveyor in a stack and on edge cannot maintain view of the road while using the parking assistance system to park the vehicle.

The invention relates more particularly to mailpiece joggers that equip such sorting outlets.

PRIOR ART

Joggers of the helical-blade wheel type are frequently used in postal sorting machines for enabling stacks of mailpieces to be formed in the receptacles of the sorting outlets.

The helical blade of the wheel of a jogger generally projects through an opening in the bottom of the sorting outlet receptacle and makes it possible to push the base of a current mailpiece against the stack of mailpieces being formed.

The wheel is driven in rotation by a transmission shaft having a motor-driven belt that is disposed under the receptacle.

During the sorting stage during which the mailpieces are machine sorted, the movement in rotation of the wheel is continuous so that the mailpieces are nudged automatically as soon as they arrive at the sorting outlet.

Generally, helical blades that are made of plastics materials are used because they limit damage to the mailpieces being stacked in the sorting outlets.

However, maintenance operatives have observed that the friction exerted on such wheels by mailpieces, most of which are made of paper, a material known for being abrasive, rapidly causes wear on helical blades made of plastics materials.

A helical blade in a poor state causes jams at the sorting outlet, and stacking of poor quality.

Such frequent wearing of the helical blade rapidly requires the worn wheel to be replaced by maintenance operatives.

Unfortunately, the helical blade is difficult to access since, to access it, it is necessary firstly to disassemble at least the sorting outlet receptacle, the transmission shaft, and its belt.

Such maintenance therefore requires the sorting machine to be shut down completely for a long period of time.

The business interruption costs resulting from such loss of use of the machine are currently higher than the costs generated by poor stacking quality.

That is why maintenance departments prefer to wait for all of the wheels of the sorting outlets or for any other parts disposed under the receptacle to be worn before shutting down the sorting machine completely, at the risk of having stacking of poor quality.

SUMMARY OF THE INVENTION

This section provides a general summary of the present disclosure and is not a comprehensive disclosure of its full scope or all of its features, aspects, and objectives.

An object of the invention is therefore to remedy those drawbacks.

To this end, the invention provides a postal sorting machine comprising an unstacker in a mailpiece feed inlet via which mailpieces are fed in, a sorting conveyor designed to put the mailpieces unstacked from the feed inlet in series and on edge, and sorting outlets, each of which is provided with a receptacle designed to store the mailpieces coming from said sorting conveyor in a stack and on edge, each sorting outlet being provided with a wheel having a helical blade, which wheel projects through an opening in the bottom of the receptacle, and is mounted on a transmission shaft disposed under the receptacle to impart a rotary movement to the helical blade so that the helical blade pushes the base of a current mailpiece in the receptacle against the stack of mailpieces that is being formed, said postal sorting machine being characterized in that the wheel is mounted on the transmission shaft by being clipped by moving in translation across the axis of rotation of the transmission shaft.

The basic idea of the invention consists in no longer having to disassemble the receptacle or the transmission shaft in order to change the helical-blade wheel. The idea is also to enable the maintenance staff to change the wheel in a working position that is ergonomic.

For that purpose, in this example, the helical-blade wheel of the invention can be mounted in and removed from the sorting outlet via the opening in the receptacle in which the mailpieces are stacked. The wheel moving in translation across the axis of rotation of the shaft makes it possible, while it is being removed, to extract it easily via the opening in the receptacle, and, while it is being mounted, to insert it through the opening, and then to clip it to the transmission shaft. It can be understood that the maintenance staff can change the wheel frequently without having to disassemble the sorting outlets, merely by positioning themselves in the vicinity of the sorting outlets so as to reach, at arm's length, the openings in the bottoms of the receptacles.

The time saved makes it possible, in this example, not only to change the wheels frequently so as to guarantee good stacking in the sorting outlets, but also to reduce the maintenance time and the downtime of the machine.

The sorting machine of the invention may also have the following features:

the wheel may have a rim provided with a hole arranged to enable the clipping means to be unclipped via the opening in the bottom of the receptacle;

the wheel and the transmission shaft may be provided with guide means for causing the wheel to move in translation across the axis of rotation of the shaft; the wheel moving in translation across the axis of rotation of the shaft enables the wheel to position itself correctly on the shaft, so as that the axes of rotation of the wheel and of the transmission shaft coincide and so as to facilitate clipping by guiding being provided throughout the movement in translation; and the guide means may be formed by a groove that extends transversely across the axis of rotation of the wheel and by a peg that extends at one of the ends of the transmission shaft transversely across its axis of rotation, and that is adapted to move in the groove.

BRIEF DESCRIPTION OF THE DRAWINGS

The disclosure is best understood from the following detailed description when read in conjunction with the accompanying drawings. It is emphasized that, according to common practice, the various features of the drawings are not to-scale. On the contrary, the dimensions of the various features are arbitrarily expanded or reduced for clarity.

DESCRIPTION OF AN EMBODIMENT

Figure 1:
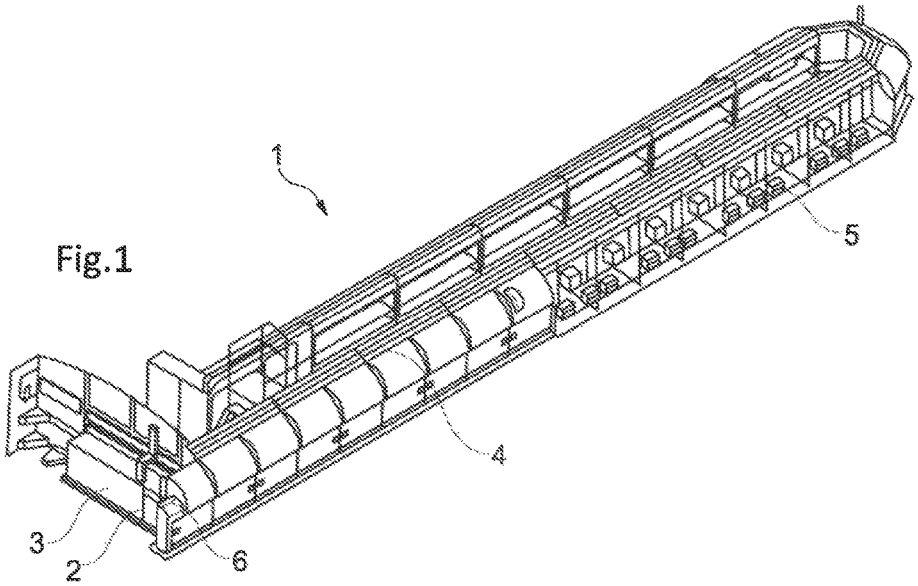
FIG. 1 is a diagrammatic view of a postal machine of the invention.

FIG. 1 shows a postal sorting machine 1 of the invention for sorting mailpieces 2 into a stack corresponding to the delivery round;

The term "mailpieces" is used to mean letters, catalogs, magazines, and any other postal article that can be put into series and that bears sorting information.

In this example, the sorting machine 1 comprises a mailpiece feed inlet 3 via which it is fed with mailpieces 2, a sorting conveyor 4, and sorting outlets 5.

The feed inlet 3 is designed to receive a storage tray containing a stack of mailpieces to be sorted into the delivery round and it comprises an unstacker 6 capable of putting the mailpieces 2 from the tray into series and on edge on the sorting conveyor 4.

The sorting conveyor 4 comprises conveyor belts (not shown) for moving the mailpieces in series and on edge over a certain conveying path to the appropriate sorting outlets.

A digital camera is installed along the conveying path on the sorting conveyor in order to take digital images of the current mailpieces with the postal destination addresses.

A central processor unit is also provided in the sorting machine for the purposes of retrieving said digital images, of recognizing the postal destination addresses and of allocating the corresponding sorting outlets to the mailpieces that are being conveyed.

Figure 2:
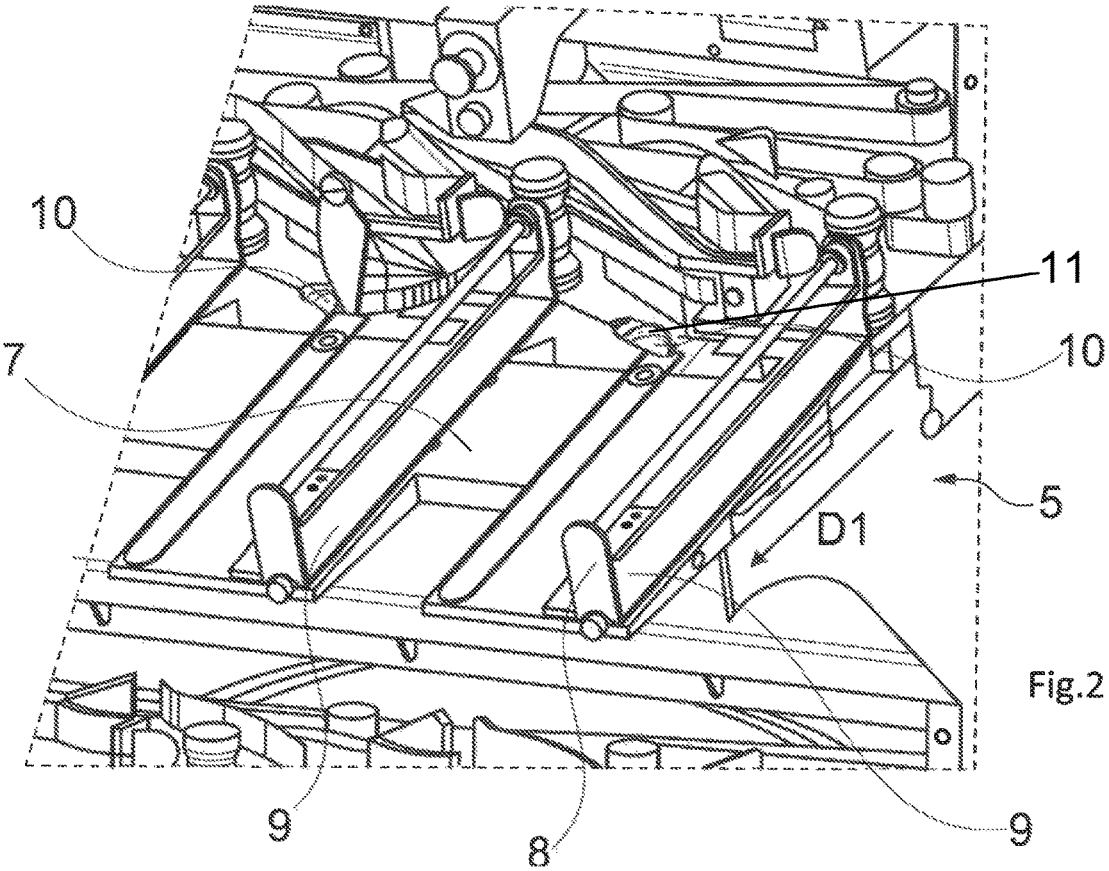
FIG. 2 is a diagrammatic view of a sorting outlet of a postal machine of the invention seen from above.

As shown in FIG. 2, a sorting outlet 5 of the invention is provided with a receptacle suitable for receiving, from the sorting conveyor 4, the mailpieces 2 on edge, one behind another and in a certain longitudinal sorting direction indicated by arrow D1. The accumulation of mailpieces in the receptacle makes it possible to form a stack.

In this example, the receptacle is in the form of tray having three sides and comprising a sloping support 7 on which the mailpieces are stored on edge, a jogging edge 8 against which the stack of mailpieces abuts face-on, and two side separation walls 9 for separating the sorting outlets 5 laterally from one another.

Each outlet 5 also has a jogger 10 comprising a wheel 11 having a helical blade 12, which wheel projects through an opening in the bottom of the receptacle, i.e. in the support 7 in this example, which opening is dedicated to this purpose.

Figure 3:
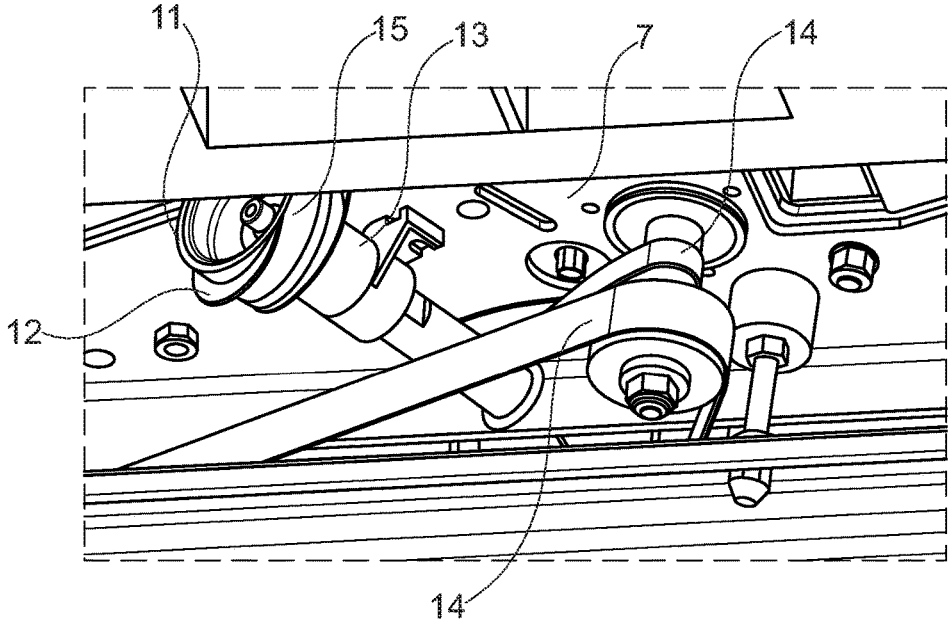
FIG. 3 is a diagrammatic view of a sorting outlet of a postal machine of the invention seen from below.

As shown in FIG. 3, the wheel 11 is, in this example, mounted on a motor-driven transmission shaft 13 disposed under the support 7. The transmission shaft 13 is driven in rotation via a set of belts 14 that are driven continuously by a motor.

The entire rotary drive system is disposed under the support 7, and only the helical blade 12 on the wheel 11 projects through the opening in the bottom of the support 7, as shown in FIGS. 2 and 3. The wheel 11 comes flush with the bottom of the receptacle so as to close off the opening as much as possible.

Figure 4:
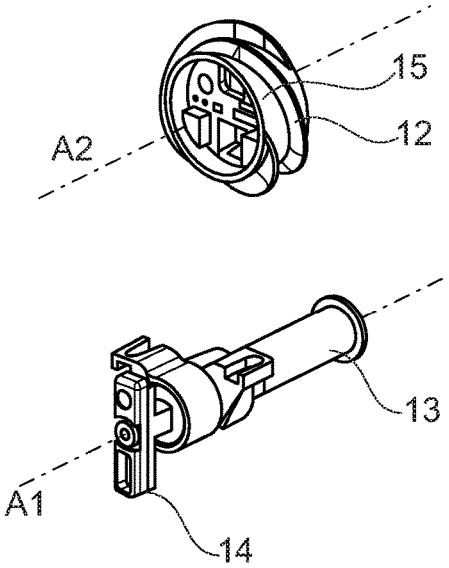
FIG. 4 is a diagrammatic view of a helical-blade wheel and of a transmission shaft of the invention before clipping takes place.

As shown in FIGS. 3 and 4, the helical blade 12 preferably extends around the rim 15 of the wheel 11 from one edge to another so as to extend through one full turn of the rim 15 of the wheel.

The helical blade 12 moving in rotation makes it possible to push the base of a current mailpiece 2 into the receptacle in said longitudinal direction D1 against the stack of mailpieces that is being formed.

Figure 6:
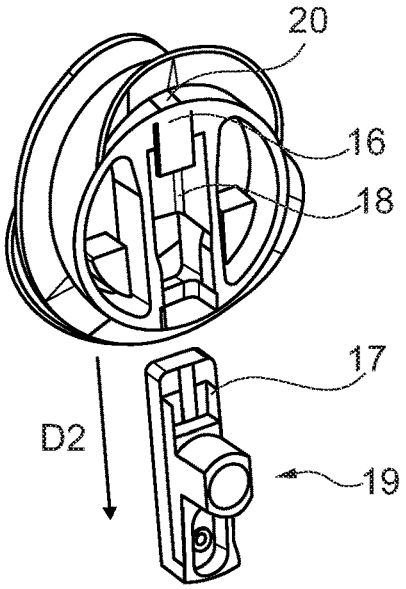
FIG. 6 is a diagrammatic view of a helical-blade wheel and of a peg on the transmission shaft of the invention before clipping takes place.

To increase the quickness with which a current mailpiece is engaged, each wheel may be provided with a plurality of helical blades 12 that are substantially parallel with one another over the rim 15, and, in this example, with three segments, as shown in FIGS. 3, 4, and 6.

Figure 7:
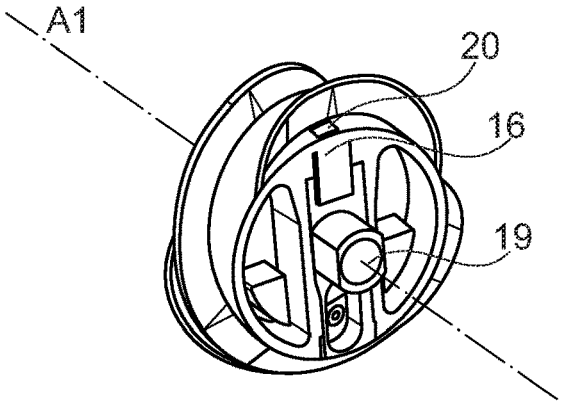
FIG. 7 is a diagrammatic view of a helical-blade wheel and of a peg on the transmission shaft of the invention after clipping takes place.

In addition, quick-acting clipping means are also provided for the purpose of fastening the wheel 11 to the transmission shaft. For this purpose, the wheel is provided with a deformable catch 16 and the transmission shaft is provided with an abutment 17 at its end via which the wheel is fastened. The catch is designed to be deformed over the abutment and to come and be lodged behind the abutment to lock the wheel onto the transmission shaft, as can be seen in FIGS. 6 and 7. The clipping takes place in a movement in translation across the axis of rotation A1 of the transmission shaft, as indicated by arrow D2 in FIG. 6.

In order to facilitate mounting the jogger in the sorting outlet, the wheel 11 and the transmission shaft 13 comprise guide means for moving the wheel in translation across the axis of rotation of the shaft.

In this example, these guide means, shown in FIGS. 6 and 7 are formed by a groove 18 that extends across the wheel transversely relative to the axis of rotation A2 of the wheel and by a peg 19 that extends at one of the ends of the transmission shaft transversely to its axis of rotation, as shown in FIG. 4.

It should be understood that the peg 19 is adapted to move in the groove 18 in the transverse movement in translation indicated by arrow D2.

It should also be understood that the abutment 17 is placed on the peg 19.

Figure 5:
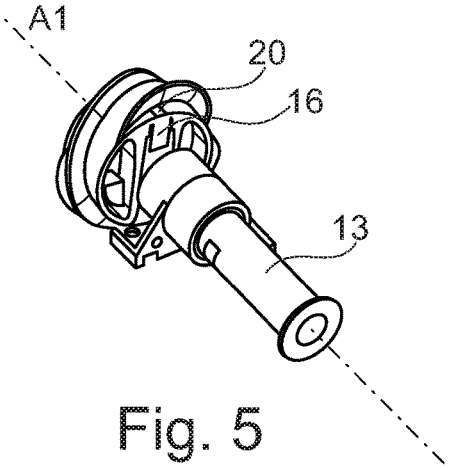
FIG. 5 is a diagrammatic view of a helical-blade wheel and of a transmission shaft of the invention after clipping takes place.

The rim 15 of the wheel 11 is also provided with a hole 20 that can be seen in FIGS. 5, 6, and 7, and that is accessible from the opening in the bottom of the receptacle to enable the clipping means to be unclipped.

More particularly, said hole 20 gives access to the deformable catch 16 by means of a thin tool, e.g. a screwdriver, so as to exert pressure on said catch, and, by a lever effect, so as to dislodge it from the abutment 17 on the peg 19.

It can be understood that the hole 20 also serves as a visual marker for a maintenance operative who wishes to place the wheel in an appropriate position for dislodging the catch 16 from the abutment 17.

In order to change a worn wheel, an operative therefore, firstly, has to turn the worn wheel until the hole 20 is visible through the opening in the support 7. The operative then engages a screwdriver in the hole until the screwdriver reaches the catch 16, and then presses against the catch to dislodge it from the abutment 17. The operative then removes the wheel 11 through the opening in the support 7 by moving it in translation across the axis of the rotation A1 of the transmission shaft 13.

In order to insert a new wheel 11, the operative firstly has to insert the wheel 11 through the opening in the support 7 by moving it in translation across the axis of rotation A1 of the transmission shaft 13.

Then, once the catch 16 reaches the abutment 17, the operative exerts additional pressure on the wheel 11 in translation across the axis of rotation A1 of the transmission shaft 13 in order to lodge the catch 16 behind the abutment to fasten the wheel 11 to the transmission shaft 13.

What is claimed is:

1. A postal sorting machine comprising an unstacker in a mailpiece feed inlet via which mailpieces are fed in a sorting conveyor designed to put the mailpieces unstacked from the feed inlet in series and on an edge, sorting outlets, wherein each sorting outlet is provided with:

a receptacle designed to store the mailpieces coming from said sorting conveyor in a stack and on the edge, and, a wheel having a helical blade, the wheel projects through an opening in the bottom of the receptacle and is mounted on a transmission shaft disposed under the receptacle to impart a rotary movement to the helical blade so that the helical blade pushes the base of a current mailpiece in the receptacle against the stack of mailpieces that is being formed, wherein the wheel is mounted on the transmission shaft by being clipped by moving in translation across an axis of rotation of the transmission shaft, and, wherein the wheel has a rim provided with a hole arranged to enable the clipping means to be unclipped via the opening.

2. The postal sorting machine according of claim 1, wherein the wheel and the transmission shaft are provided with guide means for causing the wheel to move in translation across the axis of rotation (A1).

3. The postal sorting machine of claim 2, wherein the guide means are formed by a groove that extends transversely across an axis of rotation (A2) of the wheel and by a peg that extends at one of the ends of the transmission shaft transversely across the axis of rotation (A1), and that is adapted to move in the groove.

4. The postal sorting machine of claim 1, wherein the wheel has a rim provided with a hole arranged to enable the clipping means to be unclipped via the opening, and wherein the wheel and the transmission shaft are provided with guide means for causing the wheel to move in translation across the axis of rotation (A1).

* * * * *